US007545283B2

(12) United States Patent
Ikemori et al.

(10) Patent No.: US 7,545,283 B2
(45) Date of Patent: Jun. 9, 2009

(54) COMMUNICATION CONTROL SYSTEM

(75) Inventors: Takashi Ikemori, Osaka (JP); Yasushi Yamane, Osaka (JP)

(73) Assignee: Fujitsu Limited, Kawasaki (JP)

( * ) Notice: Subject to any disclaimer, the term of this patent is extended or adjusted under 35 U.S.C. 154(b) by 373 days.

(21) Appl. No.: 11/648,657

(22) Filed: Jan. 3, 2007

(65) Prior Publication Data

US 2008/0068157 A1 Mar. 20, 2008

(30) Foreign Application Priority Data

Sep. 12, 2006 (JP) ..... 2006-247140

(51) Int. Cl.
*G08B 23/00* (2006.01)

(52) U.S. Cl. ..... 340/573.4; 340/539.13

(58) Field of Classification Search ..... 340/539.13, 340/539.14, 539.15, 572.1, 572.4, 10.1
See application file for complete search history.

(56) References Cited

U.S. PATENT DOCUMENTS

| | | | |
|---|---|---|---|
| 2002/0190861 | A1 | 12/2002 | Wentworth |
| 2003/0119529 | A1 | 6/2003 | Hirokawa |
| 2004/0000994 | A1 | 1/2004 | Kuo |

FOREIGN PATENT DOCUMENTS

| | | |
|---|---|---|
| JP | 2001-52288 | 2/2001 |
| JP | 2002-101442 | 4/2002 |
| JP | 2006-171970 | 6/2006 |
| WO | 96/07998 | 3/1996 |
| WO | 2006/079165 | 8/2006 |
| WO | 2006/108077 | 10/2006 |

OTHER PUBLICATIONS

United Kingdom Search Reported dated May 3, 2007 for Application No. GB0700588.7.

*Primary Examiner*—Jeffery Hofsass
(74) *Attorney, Agent, or Firm*—Staas & Halsey LLP

(57) ABSTRACT

This invention is a communication control system which includes a monitoring terminal held by each of a plurality of persons to be monitored and an information managing apparatus for managing position information on the monitor terminal. The monitor terminal has a position information obtaining unit for obtaining geographical position information, a group setting unit for setting a group of monitor terminals of persons to be monitored who are allowed to be mutually grouped, and a first transmitting unit for transmitting the obtained position information and group setting information to the information managing apparatus. The information managing apparatus has a first receiving unit for receiving the position information and the group setting information, a management information storing unit for storing attribute information on the person to be monitored and a condition for determining a monitor level of the person to be monitored, a mutual distance recognizing unit for calculating a distance between the monitor terminals from the position information, and a monitor level determining unit for determining the present monitor level based on the calculated distance, the attribute information, and the monitor level determination condition.

10 Claims, 11 Drawing Sheets

FIG.4

(D33) PAIR (GROUP) INFORMATION

| GROUP ID | GROUP NAME | CHILD ID1 | CHILD ID2 | CHILD ID3 | ..... |
|---|---|---|---|---|---|

(D34) CAUTION AREA INFORMATION

| LATITUDE AND LONGITUDE 1 | LATITUDE AND LONGITUDE 2 | LATITUDE AND LONGITUDE 3 | LATITUDE AND LONGITUDE 4 | LATITUDE AND LONGITUDE 5 | ..... |
|---|---|---|---|---|---|

(D35) MONITOR RECEPTION INFORMATION

| CHILD ID | MONITOR LEVEL | YEAR/MONTH /DATE | TIME/MINUTE /SECOND | LATITUDE AND LONGITUDE OF PRESENT POSITION |
|---|---|---|---|---|

FIG.7A

| MONITOR LEVELS | CONDITIONS(MATCH WITH ANY ONE OF CONDITIONS) | OPERATIONS | NOTIFICATION DESTINATIONS |
|---|---|---|---|
| LEVEL 0 (L0) | ARRIVAL AT SCHOOL (CONDITION 1), ARRIVAL AT HOME (CONDITION 2), NON-MONITORING TIME ZONE (CONDITION 3) | NOTIFICATION OF ARRIVAL (CONDITIONS 1 AND 2) | HOME (CONDITION 1) SCHOOL, LOCAL MEMBER (CONDITION 2) |
| LEVEL 1 (L1) | START COMMUTING TO SCHOOL IN PAIR (GROUP) (CONDITION 1) START COMMUTING TO HOME IN PAIR (GROUP) (CONDITION 2) | NOTIFICATION OF START OF COMMUTATION TO SCHOOL (CONDITION 1) NOTIFICATION OF START OF COMMUTATION TO HOME (CONDITION 2) (NOTIFY OF POSITION INFORMATION AT PREDETERMINED INTERVALS) | HOME (NOTIFY CENTER OF POSITION INFORMATION) |
| LEVEL 2 (L2) ATTENTION CALLING MODE | (CONDITION 1) GROUP OF ONLY CHILDREN IN LOWER GRADES (CONDITION 2) GROUP OF ONLY GIRLS (CONDITION 3) ONE CHILD IN HIGHER GRADE | NOTIFY OF STATE INDICATIVE OF SATISFIED CONDITION AND NOTIFY OF POSITION INFORMATION (NOTIFICATION INTERVAL (LONG): "a" SECONDS) | HOME SCHOOL, LOCAL MEMBER, POLICE |

FIG.7B

| MONITOR LEVELS | CONDITIONS(MATCH WITH ANY ONE OF CONDITIONS) | OPERATIONS | NOTIFICATION DESTINATIONS |
|---|---|---|---|
| LEVEL 3 (L3) PRIORITY MONITORING MODE | (CONDITION 1) ONE CHILD IN LOWER GRADE<br>(CONDITION 2) ONE GIRL<br>(CONDITION 3) STAYING IN THE SAME POSITION FOR MORE THAN PREDETERMINED TIME PERIOD<br>(CONDITION 4) MOVING TO CAUTION AREA<br>(CONDITION 5) NO POSITION INFORMATION RECEIVED FOR MORE THAN PREDETERMINED TIME PERIOD<br>(CONDITION 6) ONE CHILD<br>(CONDITION 7) CRIME, DISASTER, OR PRESSING OF BUZZER OCCURRING IN THE NEIGHBORHOOD AREA | NOTIFY OF STATE INDICATIVE OF SATISFIED CONDITION AND NOTIFY OF POSITION INFORMATION (NOTIFICATION INTERVAL (SHORT): "b" SECONDS)<br>NOTIFICATION FOR CAUTION TO CHILDREN<br>NOTIFICATION FOR WARNING TO CHILDREN NEAR THE SITE | HOME<br>POLICE<br>SCHOOL,<br>LOCAL MEMBER<br>SOUND NOTIFICATION TO EACH CHILD<br>ALL NEIGHBORING CHILDREN |
| LEVEL 4 (L4) EMERGENCY MODE | (CONDITION 1) OF TRAVEL AT IMPOSSIBLE SPEED DETECTED<br>(CONDITION 2) WARNING BUZZER RUNG BY CHILD<br>(CONDITION 3) TRAVEL TO OUTSIDE THE DESIGNATED AREA DETECTED<br>(CONDITION 4) TRAVEL TO INSIDE THE DESIGNATED AREA DETECTED | NOTIFY OF STATE INDICATIVE OF SATISFIED CONDITION AND NOTIFY OF POSITION INFORMATION (NOTIFICATION INTERVAL (SHORTEST): "c" SECONDS)<br>INSTRUCTION TO RUSH TO SITE<br>NOTIFICATION FOR CAUTION TO CHILDREN NEAR THE SITE | HOME, POLICE, SCHOOL, LOCAL MEMBER, NEIGHBORING LOCAL MEMBERS, AND CHILDREN NEAR THE SITE |

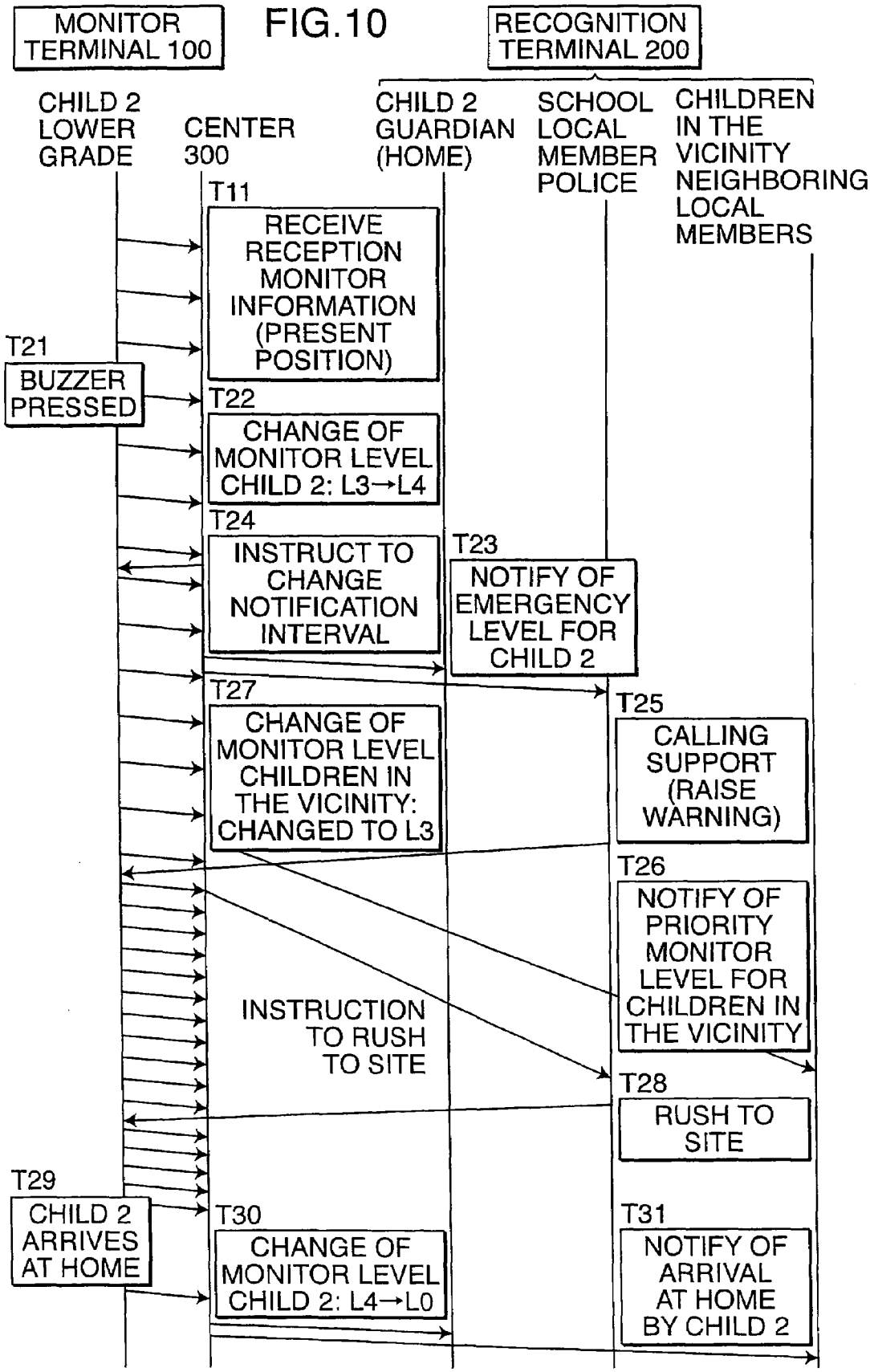
MONITOR TERMINAL 100
FIG.10
RECOGNITION TERMINAL 200
CHILD 2 LOWER GRADE
CENTER 300
CHILD 2 GUARDIAN (HOME)
SCHOOL LOCAL MEMBER POLICE
CHILDREN IN THE VICINITY NEIGHBORING LOCAL MEMBERS
T11
RECEIVE RECEPTION MONITOR INFORMATION (PRESENT POSITION)
T21
BUZZER PRESSED
T22
CHANGE OF MONITOR LEVEL CHILD 2: L3→L4
T24
INSTRUCT TO CHANGE NOTIFICATION INTERVAL
T23
NOTIFY OF EMERGENCY LEVEL FOR CHILD 2
T27
CHANGE OF MONITOR LEVEL CHILDREN IN THE VICINITY: CHANGED TO L3
T25
CALLING SUPPORT (RAISE WARNING)
T26
NOTIFY OF PRIORITY MONITOR LEVEL FOR CHILDREN IN THE VICINITY
INSTRUCTION TO RUSH TO SITE
T28
RUSH TO SITE
T29
CHILD 2 ARRIVES AT HOME
T30
CHANGE OF MONITOR LEVEL CHILD 2: L4→L0
T31
NOTIFY OF ARRIVAL AT HOME BY CHILD 2

COMMUNICATION CONTROL SYSTEM

CROSS-REFERENCE TO RELATED APPLICATION

This application is related to Japanese patent application No. 2006-247140 filed on Sep. 12, 2006 whose priority is claimed under 35 USC §119, the disclosure of which is incorporated by reference in its entirety.

BACKGROUND OF THE INVENTION

1. Field of the Invention

The present invention relates to a communication control system and, more particularly, to a communication control system of monitoring information transmitted/received between an information management apparatus and a monitor terminal or the like to assure the safety of a person to be monitored such as a child, prevent a crime, and increase a crime suppressing effect.

2. Description of the Related Art

In recent years, in consideration of increasing tendency of crimes on children, monitor systems for checking the safety of a child by using a GPS or cellular phone are being proposed.

For example, a system is used in such a manner that a GPS cellular phone whose position can be grasped by the GPS is held by a child and the present position of the child is recognized using a personal computer or a cellular phone by a guardian of the child or a school-related person.

Another system is also used in which, in a case where a child himself/herself senses a danger and rings a buzzer interlocked with a GPS cellular phone, present position information on the child is automatically notified to a terminal of a guardian or the like.

Further another system has been also proposed in which a monitoring area including school roads of a child is preregistered in a GPS cellular phone and, when the child steps out of the monitoring area, present position information on the child is automatically notified to a terminal of a guardian or the like, or an alarm sound is generated by the GPS cellular phone of the child (refer to Japanese Patent Publication No. 2006-171970).

A position information distributing apparatus for automatically notifying a monitoring person only when a person to be monitored takes an unexpected action different from schedule data registered preliminarily has been also proposed (refer to Japanese Patent Publication No. 2002-101442).

Further, a sound notifying apparatus has been proposed in which electric waves are transmitted/received between a wireless parent terminal and a wireless terminal carried by a person who wanders or the like and, in a case where the terminals are apart from each other only by a distance in which the electric waves are not received, a message is generated in sound from each of the terminals (refer to Japanese Patent Publication No. 2001-52288).

However, the above conventional monitoring systems and the like have the following problems.

(1) With the system capable of recognizing the present position of a child, even if a guardian or the like can grasp the present position of the child on his/her way between school and home, the guardian cannot grasp if the child is in a dangerous situation or not. That is, from the viewpoint of confirmation of the safety of a child, grasped position information is insufficient.

(2) In a case where a child rings an anticrime buzzer by himself/herself, a child particularly in a lower grade may be in a situation where such an operation is difficult. It may be too late even if a guardian or the like recognizes the position after the child rings the buzzer.

(3) In the system of sending a notification when a person to be monitored steps out of the monitoring area, the reason why the person to be monitored steps out of the area is unknown, whether a crime or an accidental action by a child in normal commutation to/from. There is a possibility that a crime occurs even in the registered monitoring area. That is, it cannot be said that a child on the normal school road is safe. Distinction between inside and outside of the monitoring area and a possibility that a child is involved in a crime do not always match.

(4) In the system of preliminarily registering schedule data, when there are various plans, it is troublesome to register the plans. Even in a case where there is no danger, if a person to be monitored acts differently from the registered schedule, a notification is sent erroneously.

Further, in a case where a person to be monitored is a child or the like, the child acting according to the schedule may be involved in a crime, and assurance of safety is insufficient.

As described above, the assurance of safety is insufficient in the conventional monitoring systems and the like. Since there is a possibility that a person to be monitored is involved in a crime even in an area and an action range which are usually considered to be safe, more sufficient assurance of the safety in such a case, suppression of a crime, and the like are demanded.

There is statistical data such that about 80 percent of crimes on children occur when a child is alone. It is therefore demanded to concentratedly monitor when a child become alone or a small number of children are together even on normal school roads and in the monitoring area.

SUMMARY OF THE INVENTION

The present invention provides a communication control system comprising a monitoring terminal held by each of a plurality of persons to be monitored and an information managing apparatus for managing position information on the monitor terminal, wherein the monitor terminal includes a position information obtaining unit for obtaining geographical position information, a group setting unit for setting a group of monitor terminals of persons to be monitored who are allowed to be mutually grouped, and a first transmitting unit for transmitting the obtained position information and group setting information to the information managing apparatus, and the information managing apparatus includes a first receiving unit for receiving the position information and the group setting information, a management information storing unit for storing attribute information on the person to be monitored and a condition for determining a monitor level of the person to be monitored, a mutual distance recognizing unit for calculating a distance between the monitor terminals from the position information received from each of the monitor terminals belonging to the set group, and a monitor level determining unit for determining the present monitor level of the person to be monitored based on the calculated distance, the attribute information on the person to be monitored, and the monitor level determination condition.

Accordingly, since the monitor level of the person to be monitored is determined by using the mutual distance between the monitoring terminals and the attribute information on the person to be monitored, more accurate monitoring and prompt response can be realized in accordance with the present state of the person to be monitored. In particular, since the monitor level is determined by using the attribute information on the person to be monitored in addition to the position information and the mutual distance between the monitor terminals, a dangerous state which cannot be grasped only from the position can be detected.

BRIEF DESCRIPTION OF THE DRAWINGS

FIG. 4 is a diagram showing another example of management information on the information managing apparatus of the present invention;

FIGS. 7A and 7B are diagrams showing an example of monitor level information of the present invention;

FIG. 10 is a time chart of the state change of the monitor level of a second embodiment of the present invention.

DESCRIPTION OF THE PREFERRED EMBODIMENTS

Figure 1:
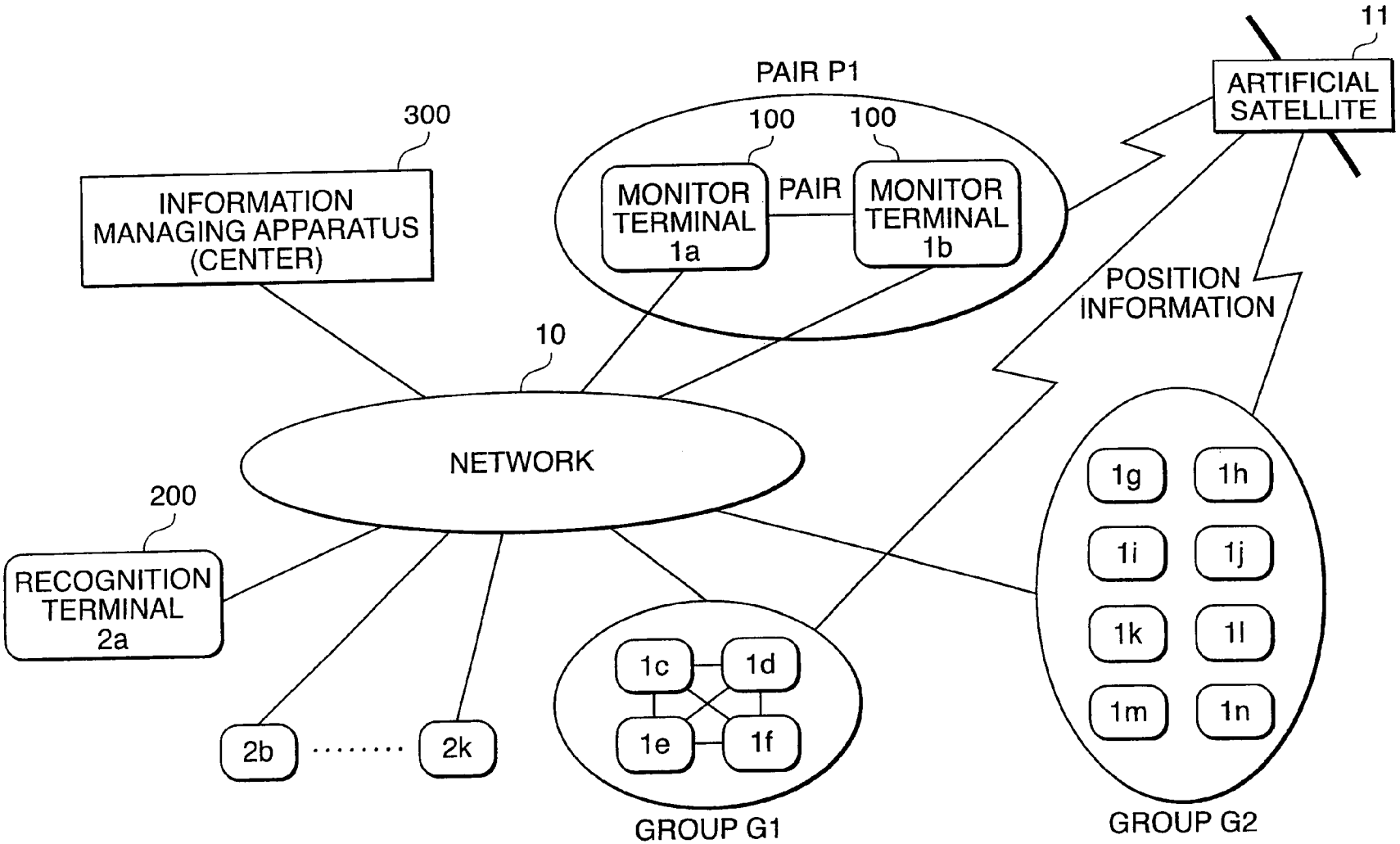
FIG. 1 is a diagram showing a general configuration of an embodiment of a communication control system of the present invention.

The present invention provides a monitor information communication control system which does not simply transmit/receive position information but can change a monitoring manner and a notifying manner based on specific conditions adapted to a person to be monitored.

The communication control system according to the present invention further comprises a recognition terminal for recognizing a monitor state of the specific person to be monitored, wherein the information managing apparatus executes an operation preliminarily associated to the monitor level determined by the monitor level determining unit, and notifies the recognition terminal of state information for identifying the present monitor level of the person to be monitored.

Accordingly, the present state information adapted to the monitor level of the person to be monitored is notified to the recognition terminal. Consequently, the safety of the person to be monitored can be recognized more accurately, load of monitoring on the person recognizing the monitor state of the person to be monitored with the recognition terminal can be lessened, and more prompt response is realized. Thus, an effect of preventing and suppressing a crime can be increased.

Further, the present invention provides the communication control system, wherein the recognition terminal includes an input unit for registering the attribute information on the respective person to be registered and a list of the persons to be monitored who are allowed to be mutually grouped, and a second transmitting unit for transmitting the attribute information on the registered persons to be monitored to the information managing apparatus and transmitting the list of the persons to be monitored to the monitor terminal.

Accordingly, the monitor information such as the attribute information on the person to be monitored can be registered by the monitoring person using the recognition terminal. By preliminarily transmitting the information to the information managing apparatus, accurate recognition of the safety and monitoring can be realized.

Further, the monitor terminal includes a monitor information storing unit for storing the list of the persons to be monitored, and the group setting unit sets a group of only monitor terminals of the persons to be monitored included in the list of the persons to be monitored and does not set a group with a monitor terminal of a person to be monitored who is not included in the list.

Accordingly, the person to be monitored who can be set in a group can be limited, so that more accurate monitoring is realized. The list of persons to be monitored who are allowed to be mutually grouped will be called a white list in the following embodiments.

Further, the recognition terminal includes a notification information generating unit for generating notification information to be notified to a monitoring person by using the state information on the person to be monitored, which is notified from the information managing apparatus.

Moreover, the recognition terminal includes a notifying unit, the state information on the person to be monitored notified from the information managing apparatus includes the present monitor level of the person to be monitored, the present position information, and the attribute information, the notification information generated by the notification information generating unit includes map information visually displaying the notified state information and sound information auditorily notifying the notified state information, and the notifying unit displays the map information and outputs the sound information.

Accordingly, a notification adapted to the present monitor level and the state information of the person to be monitored is sent. Thus, the monitoring load on the monitoring person can be lessened, and the accurate response is realized.

Further, the management information storing unit in the information managing apparatus pre-stores monitor level information including a condition for determining the monitor level and an operation executed when the condition is satisfied, and the monitor level information includes at least a non-monitor state level for not monitoring the person to be monitored, a first monitor level for indicating that the group is set and monitoring starts, and a second monitor level indicating that, after the start of monitoring, a specific person to be monitored included in the set group becomes alone or with not more than a predetermined number of persons.

Accordingly, the monitor level is determined according to the degree of safety, so that the present monitor state of the person to be monitored can be grasped more accurately.

The specific person to be monitored at the second monitor level is determined based on the attribute information on the person to be monitored.

Accordingly, the person to be monitored at the monitor level is determined based on not only the present position information on the person to be monitored but also the attribute information thereof. Consequently, a dangerous state which cannot be grasped only from the position of the person to be monitored can be detected, and more accurate monitoring and a response can be performed by the monitoring person.

Further, in the present invention, the attribute information on the person to be monitored may include at least one of the name, sex, age, grade, school name, guardian specifying information, and contact information on the person to be monitored the person to be monitored according to the present invention may be a child, a wandering person, a tour participant, a team worker, or the like.

Embodiments of the present invention will be described hereinafter with reference to the drawings. However, the present invention is not limited to the foregoing embodiments.

In the invention, position information can be obtained by using electric waves sent from an artificial satellite and it is sufficient to use a so-called GPS for this purpose. A position information obtaining unit corresponds to a GPS position information receiving unit in the following embodiment.

A group setting unit corresponds to a pair (group) setting unit in the following embodiment. A group is a unit of two or more people. In the following embodiment, a group of two persons will be called a pair. That is, the pair is a narrower term of the group.

Attribute information on a person to be monitored is transmitted to the information managing apparatus for determining a monitor level. In a case of determining the monitor level on a monitor terminal side, the attribute information may be transmitted to the monitor terminal or pre-stored in a storage of the monitor terminal.

Configuration of Communication Control System of the Invention

FIG. 1 is a diagram showing a general connection configuration of a communication control system of the present invention.

In FIG. 1, the communication control system using monitor information of the present invention includes, mainly, a monitor terminal (also called monitor TE) 100 carried by a person to be monitored (for example, a child), a recognition terminal (recognition TE) 200 possessed by a monitoring person (for example, a guardian), and an information managing apparatus (also called a center) 300 for managing monitor information, register information, and the like in a centralized manner, determining the monitor level of the person to be monitored, and notifying of the monitor level.

The terminals (100 and 200) and the apparatus 300 are connected to each other via a network 10 and transmit/receive various data such as monitor information.

The information managing apparatus 300 is a computer mounted in, for example, a security company, a local crime-prevention company, a public facility, a police station, a school, or the like.

The apparatus 300 has a configuration similar to that of a general personal computer or workstation and provides, for example, a microcomputer (including a CPU, a ROM, a RAM, an I/O controller, and a timer), a network connection module, and a recording device such as an HDD. The CPU operates various kinds of hardware based on a control program stored in the HDD, thereby realizing the communication control function of the present invention.

The recognition terminal 200 is a computer mounted in the house or office of a monitoring person who monitors a person to be monitored and is mounted in, for example, the house of a guardian, a school, a local anticrime member's house, a police station, or the like. As the recognition terminal 200, not only a personal computer but also a portable telephone and a mobile terminal having the communication function can be used.

The number of the recognition terminal 200 may be one. When there is a plurality of monitoring persons (for example, guardians), recognition terminals 200 of the number (2*a* to 2*k*) equal to the number of the monitoring persons exist.

The recognition terminal 200 performs a process of inputting and setting registration information which will be described later, a process of recognizing the position of the monitor TE 100 and the monitor level and notifying the monitoring person of the position of the monitor TE 100 and the monitor level, and the like.

Recognition of the monitor level is, for example, recognition of whether a person to be monitored (child) acts alone or in a group or is in a situation where risk is high.

The monitor terminal 100 is a small-sized computer carried by the person to be monitored. For example, a cellular phone having the communication function is used.

The monitor TE 100 always receives a GPS signal (position information) from an artificial satellite 11 and has the function of specifying the position (latitude and longitude) of itself. Each monitor TE 100 is carried by, for example, a child as a person to be monitored and a plurality of monitor TEs (1*a* to 1*n*) exist.

The plurality of monitor TEs 100 are set in a pair or group within the range of preliminarily registered persons to be monitored. The setting of a pair or group is made for each specific event. Examples of the specific event are commutation to a school of a child, communication from the school, commutation to the school in a group, a group activity such as a school excursion or school trip, and the like.

For example, when two children as persons to be monitored go to or come back from a school together, the monitor TEs (1*a* and 1*b*) carried by the two children are paired.

When a plurality of children go to or come back from a school in a group, the monitor TEs carried by the children are grouped.

For example, in FIG. 1, a pair (P1) is made by the two monitor TEs (1*a* and 1*b*), a group (G1) is made by four monitor TEs (1*c* to 1*f*), and a group (G2) is made by eight monitor TEs (1*g* to 1*n*).

The pair setting is a setting such that two monitor TEs 100 act together without being apart from each other more than predetermined distance (for example, 10 m). The group setting is a setting such that a plurality of monitor TEs 100 act together without apart from each other more than predetermined distance. Whether they are apart from each other more than predetermined distance or not can be determined by using position information from the artificial satellite received by the monitor TEs 100.

The invention is characterized in that in a case where a change occurs in the form of the pair or group due to the action of the person to be monitored (such as a child) after making such pair setting or group setting, the monitor level (also called a monitoring mode) is flexibly changed according to the situation of the change.

In a case where the person to be monitored is a child, when the child acts with another child in a pair or other children in a group without being apart from each other, it is considered that the possibility of being involved in a crime is relatively low. Consequently, the monitor level is set to be low, and the frequency of sending a notification and making a check is set to be low.

On the other hand, in a case where the person to be monitored acting in the pair or group changes to act alone or acts with a small number of children apart from the group more than the predetermined distance, it is considered that the possibility that the child is involved in a crime is high. Consequently, the monitor level is increased, the frequency of sending a notification and making a check is increased, and a special monitoring operation is performed as necessary.

For example, in FIG. 1, when two children having the monitor TEs (1*a* and 1*b*) are paired and start coming home together from the school, the center side always grasps the position information on the monitor TEs (1*a* and 1*b*) of the children. When they act while maintaining the predetermined distance (for example, 10 m), the monitor level is set to be low (level L1) and nothing is notified to the guardians.

On the other hand, when it is found that the state where they are apart from each other more than the predetermined distance for more than predetermined time based on the position information on the two monitor TEs, it is determined that each of the children became alone, the monitor level is changed to a high level (level L3), and the state where the child is alone is notified to the guardian.

The above description is an example. By changing the monitor level based on position information on each of the monitor TEs and making a check corresponding to the state of the person to be monitored, the load of monitoring on the monitoring person can be lessened, a crime can be prevented and suppressed, and reliability of acknowledge of safety can be improved.

Figure 2:
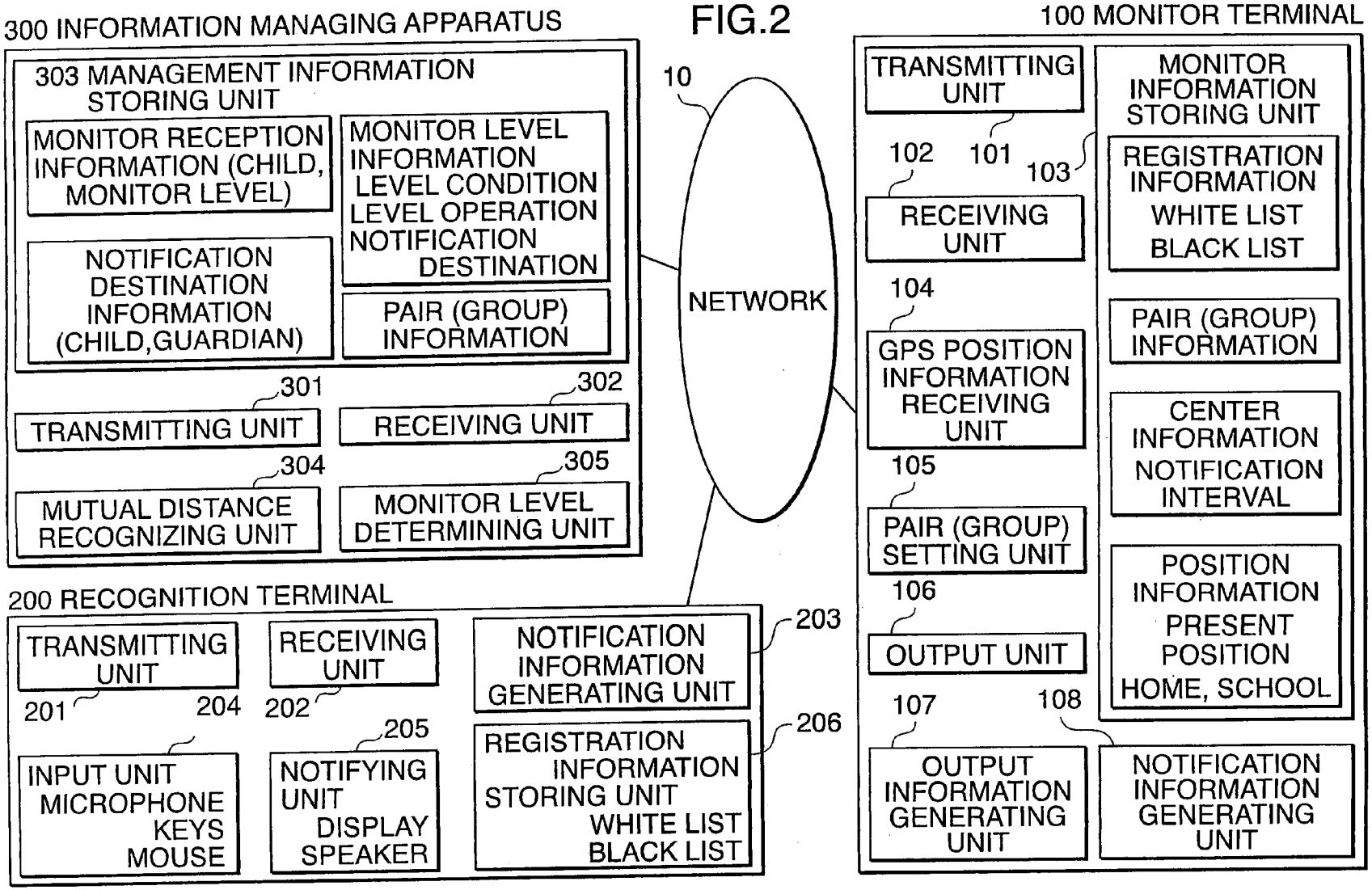
FIG. 2 is a configuration block diagram of the embodiment of the communication control system of the present invention.

FIG. 2 is a configuration block diagram showing an embodiment of a communication control system of the present invention.

The monitor TE 100, the recognition TE 200, and the information managing apparatus 300 of the present invention are connected to each other via the network 10 and send and receive monitor information and the like to/from each other.

As the network 10, for example, a wide-area communication network such as the Internet, a local area network, a wireless communication network of a cellular phone or the like, and so on can be used.

The recognition TE 200 mainly has, in addition to a transmitting unit 201 and a receiving unit 202 connected to the network 10 and performing communications, an input unit 204 for inputting registration information, a registration information storing unit 206 for storing the registration information, and a notifying unit 205 and a notification information generating unit 203 for checking the state of the person to be monitored.

The input unit 204 is provided for inputting a sound, a character, a symbol, or the like, selecting an item, and inputting a detection instruction, and the like. The input unit 204 corresponds to a microphone, keys, a mouse, and the like.

The notifying unit 205 is provided for notifying a monitoring person of the situation of a person to be monitored, monitor reception information, and the like. The notifying unit 205 corresponds to a display (LCD) for visually notifying of the information by using a character, a figure, or the like, a speaker for notifying of the information by sound, and the like.

The notification information generating unit 203 is a part for generating character information or a figure to be displayed on the display, or generating notification sound from the received monitor information. The notification information generating unit 203 is a part for generating information to be sent to the monitor TE 100 of the person to be monitored.

The registration information storing unit 206 is a memory for storing registration information entered by the monitoring person, and a rewritable memory is used.

The registration information includes a white list D11, a black list D12, the address of a center, and the address and the telephone number of the monitor TE 100. The registration information is stored in the recognition TE 200 and, as necessary, transmitted to the information managing apparatus 300 and the monitor TE 100.

The white list in the registration information is a list in which persons to be monitored (for example, children) who can be paired or grouped is recorded. The black list is a list in which persons to be monitored who cannot be paired or grouped. The white list and the black list are transmitted to the monitor TE 100.

For example, children who are in the white list can be paired (or grouped) on their way to home, but children who are in the black list cannot be paired (or grouped).

Examples of children who are in the white list are children in the neighborhood, children living in the same condominium building, children using the same school road, brothers and sisters, and friends playing together on a regular basis.

On the other hand, children in the black list are children who do not usually commute together to/from school such as children going home in different directions.

Such registration information is entered before the system operates or when it has to be changed even during operation.

Preferably, the registration information is entered by a monitoring person such as a guardian, a school staff, or the like.

The monitor terminal 100 mainly includes the transmitting unit 101, the receiving unit 102, a GPS position information receiving unit 104, a pair (group) setting unit 105, a output unit 106, an output information generating unit 107, a notification information generating unit 108, and a monitor information storing unit 103 for performing communications via a network.

The GPS position information receiving unit 104 is a part for receiving electric waves from the artificial satellite 11, and generating position information (latitude, longitude) of the monitor TE 100. In a case where information from a transmitter mounted in a predetermined point such as an intersecting point, not the electric waves from the artificial satellite, is received and the present position can be specified from the information, such reception information may be used.

Today, the present position can be specified with an error up to about 5 m by using the electric waves sent from an artificial satellite. Consequently, the distance between two monitor TEs 100 can be recognized in units of a few meters.

The pair (group) setting unit 105 is a part for setting mutual monitoring between/among a plurality of monitor TEs at a specific event such as commutation to/from a school. It is preferable to execute the pair (group) setting by manually depressing a specific button provided for each of the monitor TEs 100 to make the setting by the operator's intention more reliably or since there is a case where a pair or group varies event by event.

Depression of the specific button may be transmitted to another monitor TE 100 in the vicinity.

A case is assumed such that five children each having the monitor TE 100 gather in one place and are grouped. In a case where the specific button is depressed within predetermined time (for example, 10 seconds) in each of the five monitor TEs 100 existing in a predetermined close range, the monitor TEs 100 send information specifying the monitor TE and information indicative of depression of the specific button to each other. The five monitor TEs 100 capable of recognizing the mutual communication may be grouped.

After the group setting is made, group information made by the information specifying each of the monitor TEs 100 or the information specifying the child as the owner of the monitor TE 100 and identification information (ID) of the set group is generated.

Since there is also a case where children in the lower grades make the pair setting or group setting, preferably, the operation of the pair setting or the group setting is an operation which can be easily and reliably performed.

For example, the operation of the pair setting or the group setting may be performed by depressing a dedicated button, or making monitor terminals come close to each other or come into contact with each other.

The information generated by the pair (group) setting is stored as pair (group) information D33 as shown in FIG. 4 and transmitted to the information managing apparatus 300.

The pair setting or group setting is made only between/among children preliminarily registered in the white list.

Specifically, in a case of performing the mutual communication as described, information sent from another monitor TE 100 is recognized and a check is made to see whether the another monitor TE 100 is a monitor TE registered in the white list or not. If there is a black list, another check is made to see whether the another monitor TE 100 is a monitor TE registered in the black list or not.

When the another monitor TE is a monitor TE which is registered in the white list and is not registered in the black list, the pair setting or group setting is executed with the another monitor TE.

In other words, the monitor TE is not paired or grouped with a monitor TE which is not registered in the white list, and is not paired (grouped) with a monitor TE registered in the black list. In a case where the pair (group) setting is not made with another monitor TE, the message is output to the owner of the monitor TE by sound or display.

The output unit 106 is a part for visually or auditorily outputting an alarm or the like on the monitor TE 100 side and corresponds to a speaker, an LED, and a display (LCD).

The output information generating unit 107 is a part for generating information which is output to the output unit 106, and generates sound, a character, a figure, or the like for giving a warning corresponding to, for example, a monitor level.

The notification information generating unit 108 is a part for generating information to be notified to the center 300 or the recognition TE 200. For example, based on information received by the GPS position information receiving unit 104, the present position information is generated. When a pair setting is made, the pair (group) information D33 as shown in FIG. 4 is generated.

Alternatively, on arrival at home as one of destinations, the notification information generating unit 108 generates information indicative of arrival at the destination. The generated information is transmitted from the transmitting unit 101 to a predetermined notification destination at predetermined time intervals or immediately after generation of the information.

Examples of the information stored in the monitor information storing unit 103 in the monitor terminal 100 are information as shown in FIG. 2.

Figure 6:
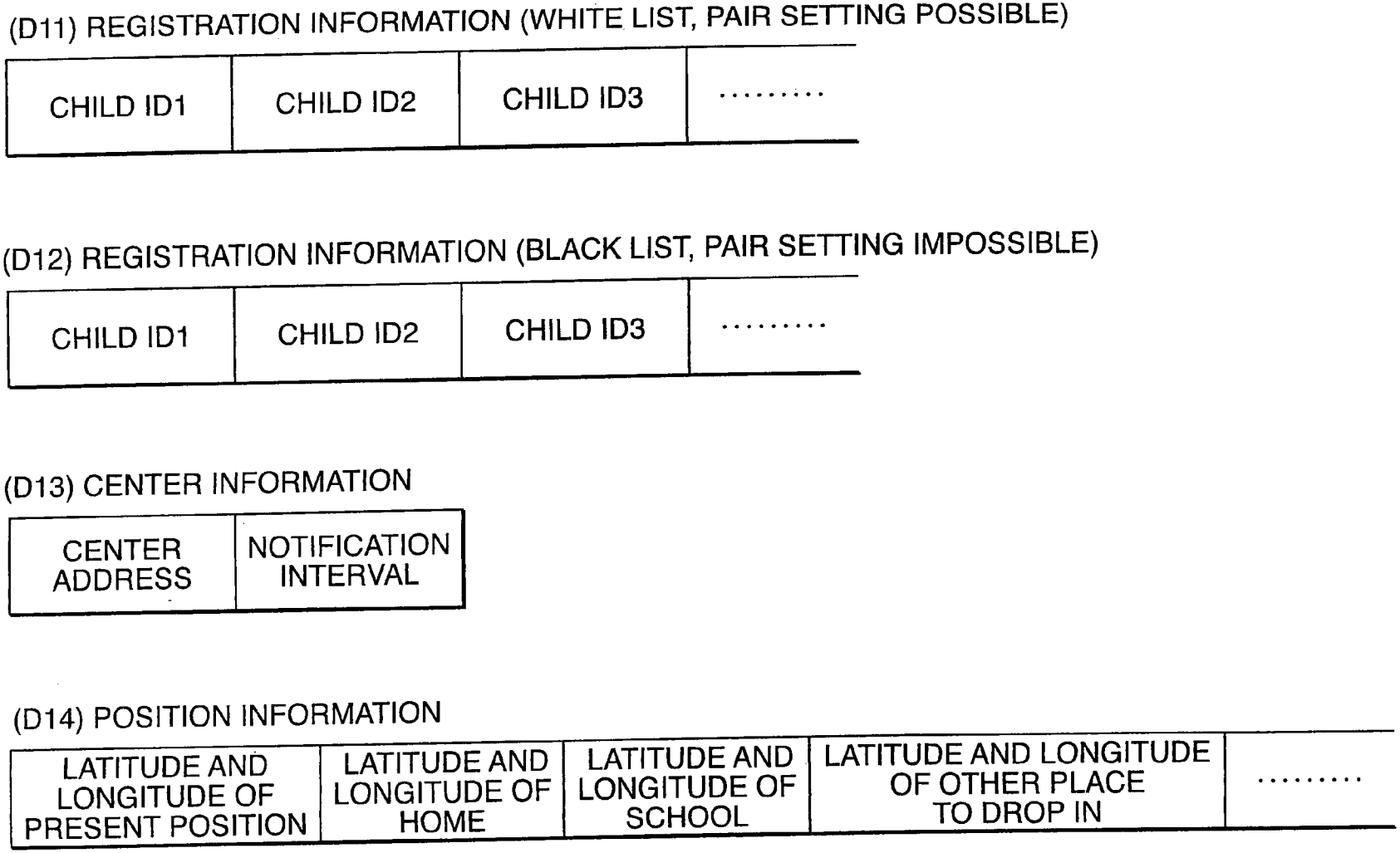
FIG. 6 is a diagram showing an example of monitor information on a monitoring terminal of the present invention.

Registration information (D11 and D12 in FIG. 6) is the white list and the black list entered in the recognition TE 200. As described above, the registration information is used for determining whether the pair setting can be made or not at the time of the pair setting made in the pair (group) setting unit 105.

The center information (D13 in FIG. 6) is information specifying the center and is made by, for example, the address of the center and notification interval.

The notification interval denotes a time interval of transmitting information on the present position of the monitor TE 100 to the center 300. One numerical value may be fixedly preset. Alternatively, to perform monitoring more properly, a plurality of notification intervals may be stored in correspondence with a plurality of monitor levels, and the notification interval may be changed each time the monitor level changes.

For example, in a case where the monitor level is low, it is considered to be relatively safe, so that a relatively long time interval (for example, 60 seconds) is set. In a case where the degree of risk is high and the monitor level is high, a relatively short time interval (for example, 15 seconds) is set to increase the notification frequency.

The notification interval may be set on the monitor TE 100 side. In a case of determining the monitor level on the center side, information on the notification interval corresponding to the monitor level may be transmitted from the center to the monitor TE 100 each time the monitor level changes.

The position information (D14 in FIG. 6) includes information (latitude and longitude) indicative of the present position of the monitor TE 100, the position information (latitude and longitude) of home, position information (latitude and longitude) of the school, and position information (latitude and longitude) of buildings and places where the owner is likely to visit.

The present position information changes with time. Since the position information on home and the like is fixed information, the position information is preset on the monitor TE 100 side or information generated by the recognition TE 200 is transferred from the recognition TE and stored preliminarily.

In the configuration of the embodiment of FIG. 2, the monitor level is determined on the center 300 side. It is also possible to provide the monitor TE 100 with a monitor level determining unit 305, determine the monitor level on the monitor TE 100 side, and execute a notifying process corresponding to the monitor level and the like.

The information managing apparatus 300 mainly has a transmitting unit 301, a receiving unit 302, a mutual distance recognizing unit 304, the monitor level determining unit 305, and a management information storing unit 303.

The mutual distance recognizing unit 304 is a part for calculating distance information for each of monitor TEs paired (grouped) by using monitor reception information including the present position information received from each of the monitor TEs 100 and the pair (group) information.

The monitor level determining unit 305 is a part of determining the present monitor level of each of the monitor TEs 100 based on the received monitor reception information and the calculated distance information. For determination of the monitor level, a level condition of the monitor level information which is preset is used.

Specifically, the level condition of a monitor level with which the present situation of the monitor TE 100 recognized by the monitor reception information matches is determined, thereby determining the present monitor level. When the monitor level changes, an operation associated with the changed monitor level is executed.

For example, when the distance information calculated for any of monitor TEs 100 belonging to a group G1 becomes predetermined distance or longer, it can be determined that the owner of the monitor TE 100 left the group G1 and became alone. In this case, the monitor level is changed to a monitor level having a level condition that "the person to be monitored became alone" and state information indicating that the person to be monitored became alone is notified to a predetermined notification destination of a guardian or the like.

Figure 5:
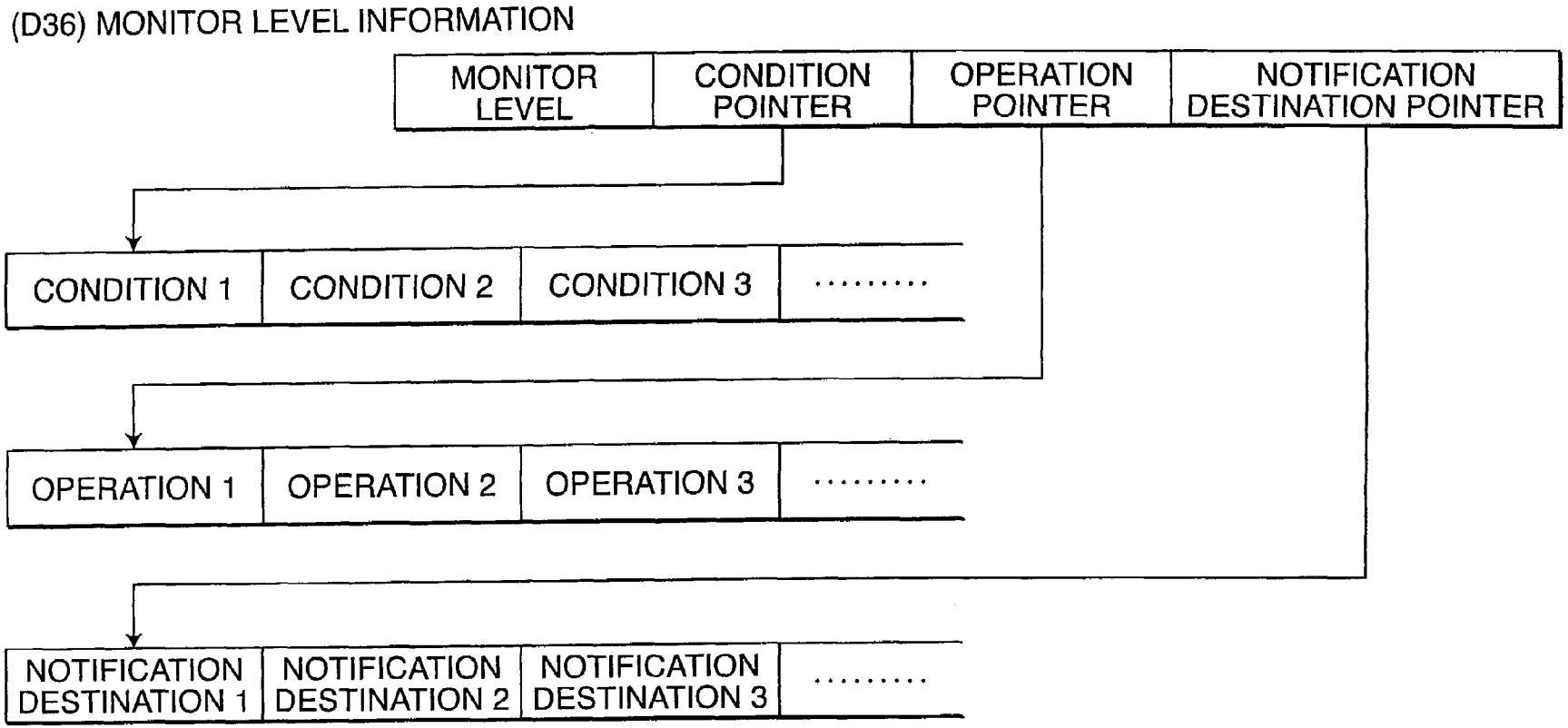
FIG. 5 is a diagram showing still another example of management information on the information managing apparatus of the present invention.

The management information storing unit 303 is a part for storing various information transmitted/received in the system of the present invention. Examples of the management information stored in the storing unit 303 are information (D31 to D36) as shown in FIGS. 3, 4, and 5.

The pair (group) information D33 and monitor reception information D35 is information sent from the monitor TE 100. Notification destination information (D31 and D32), caution area information D34 and monitor level information D36 is preset or preliminarily sent from the recognition TE 200.

Figure 3:
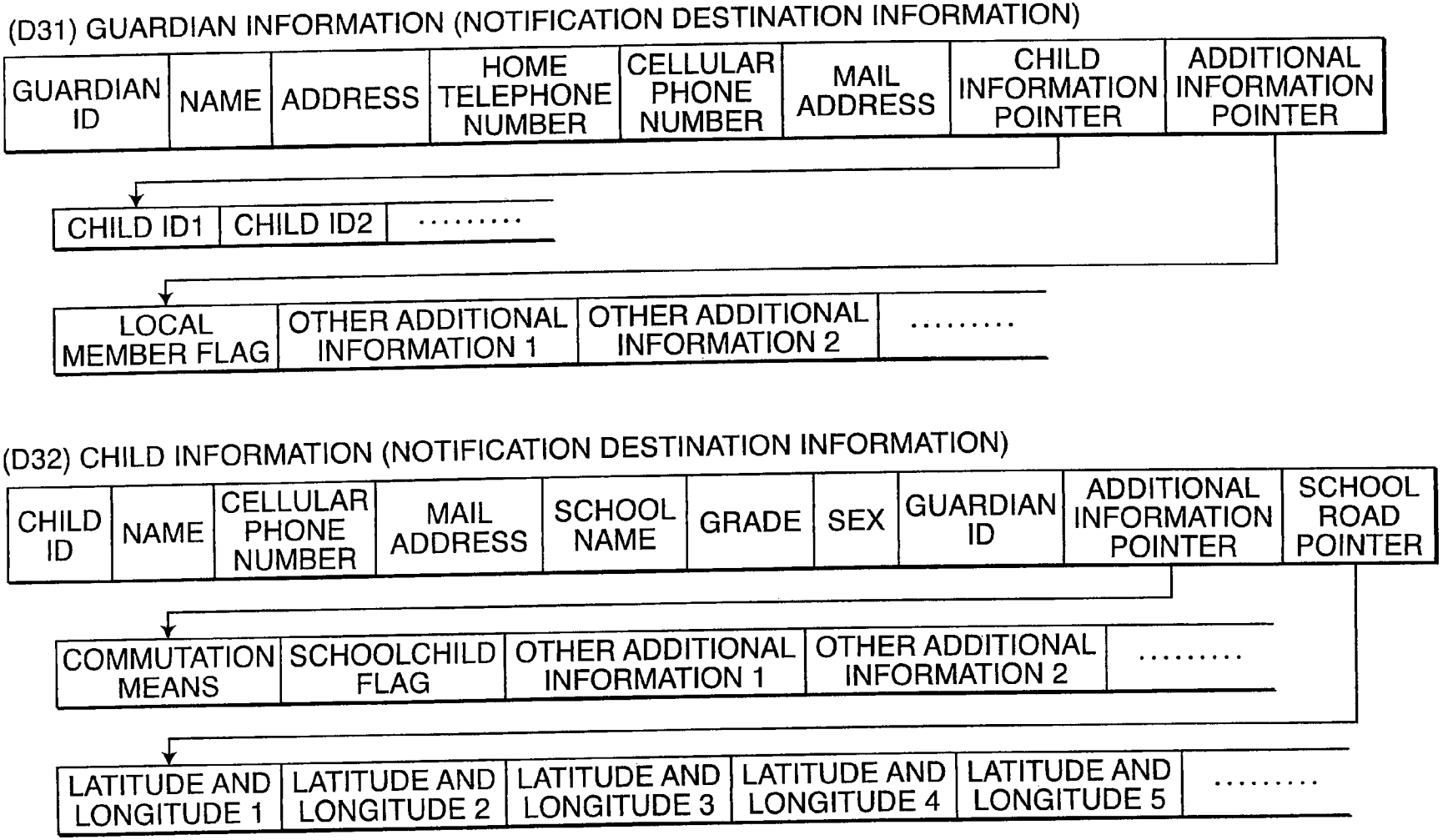
FIG. 3 is a diagram showing an example of management information on an information managing apparatus of the present invention.

In FIG. 3, as the examples of the notification destination information, guardian information D31 and child information D32 is shown.

The guardian information D31 is information that specifies a guardian and mainly includes guardian's ID, name, address, home telephone, cellular phone, mail address, child information (ID), and additional information (local commission member).

The child information D32 is information that specifies a child and mainly includes at least one piece of child's ID, name, contact information (cellular phone, mail address), school name, grade, sex, guardian specifying information (ID), home position information, school position information, additional information (commutation means and the like), and commutation route information).

It is unnecessary to include all of the information specifying the guardian and the child. Only one of them may be employed. The information is not limited to that shown in the diagram and may include other information pieces as additional information.

FIG. 4 shows an example of the pair (group) information D33, caution area information D34, and monitor reception information D35. The pair (group) information D33 is information on the monitor TE 100 subjected to the pair setting or group setting, and corresponds to pair (group) information generated by the monitor TE 100.

The pair (group) information of FIG. 4 includes a plurality of children IDs as the owners of monitor TEs 100 grouped, the group ID, and the group name.

In a case of pair setting, the IDs of two children are included. The pair (group) information may further include information on time at which the pair setting is made, the number of children, attribute information (lower/higher grades, age, sex, and characters such as whether the child fears of stranger or not, and so on).

The caution area information D34 denotes position information on an area in which the degree of monitoring is increased. Examples of the caution area information D34 are area information on a place where a crime or accident actually occurred in the past, a dark place, an empty street, a blind place, a place with a small number of street lights, and a place far from a police station.

In a case of passing such an area, to further increase the safety, preferably, even during action in a pair or group, it is preferable to perform a special operation by increasing the monitor level and shortening the interval of notification of position information from the monitor TE.

The monitor reception information D35 is information sent from each of the monitor TEs 100 and includes, for example, information such as children ID, monitor level, year/month/date, hour/minute/second, and latitude and longitude of the present position.

By using the monitor reception information D35 and the pair (group) information, the distances among the children belonging to one group are calculated.

FIG. 5 shows the monitor level information D36 pre-stored in the center 300.

The monitor level is numerical value information indicative of the degree of monitoring. For example, as will be described later, the highest monitor level is L4, the level at which no monitoring is necessary is L0, and five levels from L0 to L4 are set.

For each monitor level, the condition, operation, and notification destination are set.

The "condition" denotes a criterion of determining whether the present situation of a monitor TE 100 corresponds to the monitor level or not.

For example, in a case where a criterion that the owner of the monitor TE becomes alone is met in overall determination from the monitor reception information on the monitor TE 100, pair information, and calculated distance information, the monitor level is determined as L3 (priority monitor mode, level 3).

The "operation" denotes a process to be performed when the condition is satisfied and when the condition is satisfied and another monitor level changes to the monitor level.

For example, in a case where information (pair information) indicating that a pair (group) setting is made is received and it is recognized that the monitor level has changed from the level L0 to the level L1, an operation associated with the level L1 is executed.

In a case where a process of "notifying the guardian of information indicating that the group setting is made and commutation to school starts" is stored as an operation of the monitor level information D36 of the monitor level L1, such a notifying process is executed.

As the "notification destination", information on the other party on which the operation is to be performed is stored. In the above example, the address and telephone number of the guardian to which the notification is sent are stored.

The information stored in the storing units (103 and 303) is an example. The information varies according to the person to be monitored, the monitor level, the condition, and the like.

Concrete Example of Monitor Level Information

FIGS. 7A and 7B are diagrams illustrating a concrete example of the monitor level information D36. Actual monitor level information D36 is stored in the form of numerical data or a program which can be recognized by a computer in a nonvolatile memory.

The information D36 may be set on the center side or generated by the recognition TE 200 and transferred to the center 300.

In FIGS. 7A and 7B, five monitor levels (L0 to L4) are provided.

The level 0 (L0) corresponds to a non-monitoring mode. The other levels 1 to 4 (L1 to L4) correspond to a monitoring mode. The larger the numerical value of the level is, the higher the degree of monitoring is, that is, the greater the importance of the monitoring is.

FIGS. 7A and 7B show information generated on assumption of a child as a person to be monitored and in consideration of situations that the child commutes to/from a school.

At the level 0 in FIGS. 7A and 7B, there are three states as conditions.

Condition 1: The child having a monitor TE 100 has arrived at school.

Condition 2: The child has arrived at home.

Condition 3: The present time is in the non-monitoring time zone.

In this case, when any one of the conditions is satisfied, the monitor level of the child is determined as the level 0 (L0). The condition 1 "the child has arrived at school" can be determined from the position information D14 of the monitor TE 100 shown in FIG. 6.

For example, in a case where the information (latitude and longitude) of the present position of the child coincides with the latitude and longitude information on the school or enters the area of the position information corresponding to the site of the school, it is determined that the child having the monitor TE 100 has arrived at the school. The monitor TE 100 which determined that the child has arrived at the school transmits "information on arrival at the school" to the center 300. On receipt of the information, the center determines that the child having the monitor TE 100 has arrived at the school.

Although not shown in FIG. 3 and so on, it is also possible to pre-store the position information (latitude and longitude) of each of the school and the home, and determine, on the center side, whether the child has arrived at the school or not by comparing the present position information on the monitor TE received momentarily with the pre-stored school position information.

The non-monitoring time zone of the condition 3 corresponds to a time zone from time when the child comes back from school to time when the child leaves home for school on the following day, or Sundays and holidays.

When any of the three conditions is satisfied, the "operation" at the level 0 is executed.

For example, when the condition 1 or 2 is satisfied, "arrival notification" is transmitted. The notification destination in a case of the condition 1 is "home (guardian's home)", and that in a case of the condition 2 is "school and local member".

The level 1 (L1) in FIG. 7A is set in a case where the child makes a pair setting or group setting and starts going to school (commutation to school in a group) or starts coming back from school (commutation from school in a group).

For example, start of commutation to school can be determined when the center 300, after reception of the information indicating that the pair (group) setting is made, detects travel of the monitor TE 100 set in a pair (group). The commutation from school can be determined in a similar manner.

After the condition of the level 1 (L1) is satisfied, start of commutation to school or start of commutation from school is notified to the home of the child.

The level 2 (L2) in FIG. 7A corresponds to an attention calling mode indicating that the degree of risk becomes higher than that in the state of the level 1. For example, when any one of the following three conditions is satisfied, the level 2 (L2) is determined.

Condition 1: Only children in the lower grades are grouped.

Condition 2: Only girls are grouped.

Condition 3: The number of children in the higher grades is included.

Whether only children in the lower grades are grouped or not can be determined based on the child information (grade) pre-stored in the center and the present position information on the children who are traveling at present.

Similarly, whether only girls are group or not can be determined by referring to the child information (sex).

Whether the number of children in the higher grades is one or not can be determined from the child information (grade) and the position information on the monitor TE 100 sent momentarily.

For example, the mutual distances of monitor TEs of a plurality of children who are grouped are calculated from the present position information on the monitor TEs. In a case where a state in which the other monitor TEs which were in predetermined distance Lo (for example, 10 m) from the monitor TE of a child at the level 0 do not exist in the zone of the predetermined distance Lo continues for more than predetermined time (for example, 100 seconds), the monitor level is changed to the level 2 (L2).

In a case where the state of the level 2 continues more than a predetermined time interval (for example, "a" seconds) immediately after change to the level 2 (L2) from another level, the state information indicating the state of one of the three conditions and information on a position where the state is obtained or the present position information is notified. The notification destination is, for example, home, school, local member, or police.

Since it is considered that the degree of monitoring at the level 2 may be lower than that at the levels 3 and 4, the notification interval ("a" seconds) is set to be relatively long.

For example, "a" may be equal to 60 (seconds) or 120 (seconds).

The level 3 (L3) in FIG. 7B corresponds to a priority monitoring mode indicating that the degree of risk is higher than that at the level 2 and the degree of monitoring is rather high. For example, when any one of the following seven conditions is satisfied, the monitor level is set to the level 3.

Condition 1: the number of children in the lower grades became one.

Condition 2: the number of girls became one.

Condition 3: a state where the child stays in the same position for more than predetermined time continues.

Condition 4: entrance to a caution area is detected.

Condition 5: the position information is not received for more than predetermined time.

Condition 6: the number of children became one.

Condition 7: crime, disaster, or ringing of a buzzer occurred in the neighborhood.

Whether the child has entered the caution area or not can be detected by comparing the caution area information D34 pre-stored in the center with the present position information.

The state where position information cannot be received denotes a case where the monitor TE 100 is broken or the power is turned off. In this case, since there is the possibility that no contact can be made with the monitor TE 100, an action is taken such that someone rushes to the position immediately before the position where reception of information stopped, or an inquiry is sent to the owners of the other monitor TEs grouped.

In the condition 7, there is a case that occurrence of a critical event such as a crime like murder in the neighborhood of the present position of the child or a disaster such as fire is notified from another notifying system. The center receives the notification and sends notification for calling warning to a child near the area where the critical event occurred.

Also in a case where a child in the neighboring area A rings the buzzer, similarly, a warning is notified to a child "a" near the area A where the child rung the buzzer. The monitor level of the child "a" may be increased to the level 3.

When the monitor level is changed to the level 3 (L3), state information indicating one of the seven conditions and the present position information on the child is notified to notification destinations considered to be necessary such as home, school, local member, and police.

Since the degree of monitoring at the level 3 is higher than that at the level 2, the notifying frequency is increased. The interval ("b" seconds) of notification in this case is set to be shorter than that at the level 2 ("a" seconds) ($b<a$).

At the level 3, an operation of sending a notification by sound or the like is performed for calling warning to a child satisfying the condition. Notification by sound or the like may be automatic notification in synthetic voice or a guardian or the like may call the monitor TE and directly call for warning.

Alternatively, an e-mail for calling warning may be sent to the monitor TE of the child.

The level 4 (L4) in FIG. 7B corresponds to an emergency mode in which the degree of risk is the highest and not only simple monitoring but also a special action is necessary.

For example, when any one of the following four conditions is satisfied, the monitor level is set to the level 4.

Condition 1: Travel of the monitor TE at impossible speed is detected.

Condition 2: A child rings a warning buzzer by his/her intention.

Condition 3: Travel to the outside of a designated area is detected.

Condition 4: Travel to the inside of a designated area is detected.

Travel at impossible speed denotes a case where the present position information changes at high speed which is impossible speed in travel of commutation means (for example, on foot or bicycle) of the child.

For example, a case such that the present position information changes at 60 km/h matches the condition 1. In this case, it is assumed that the child is brought in a car and kidnapped.

In a case where a child rings a warning buzzer, interlocking with the warning buzzer, special information is notified from the monitor TE to the center. A case where the center receives the special information corresponds to the condition 2.

Also in a case where the child rings the buzzer, there is the possibility that the child is involved in a critical event such as kidnapping or accident, so that the monitor level is set to the level 4.

A case where a child enters a prohibited building or a caution area to which entrance is impossible corresponds to the condition 4. A case where the areas such as a school zone or school roads are designated and a child travels to the outside of the areas corresponds to the condition 3. Also in a case where travel of a child to the inside/outside of a special area is detected, the monitor level is changed to the level 4 since there is the possibility of kidnapping, accident, or the like.

Also in a case where the monitor level changes to the level 4 (L4), in a manner similar to the level 3 (L3), state information showing the satisfied condition and the present position information is notified to home, school, and the like. To address the event early, the notification interval ("c" seconds) in this case is preferably the shortest.

As an operation peculiar to the level 4, an instruction or request to rush to the site is notified to a guardian, school staff, or the like. When the site is far from home or the like, an instruction or request to rush to the side is notified to a local crime-prevention member or the like close to the side. Further, as the operation peculiar to the level 4, a notification by sound or the like is sent to a child near the side to call attention.

The examples of the monitor level information considered for children on their way between school and home have been described above. It is necessary to improve the conditions and operations in consideration of actual operating conditions, problems peculiar to an area, and the like.

Figure 8:
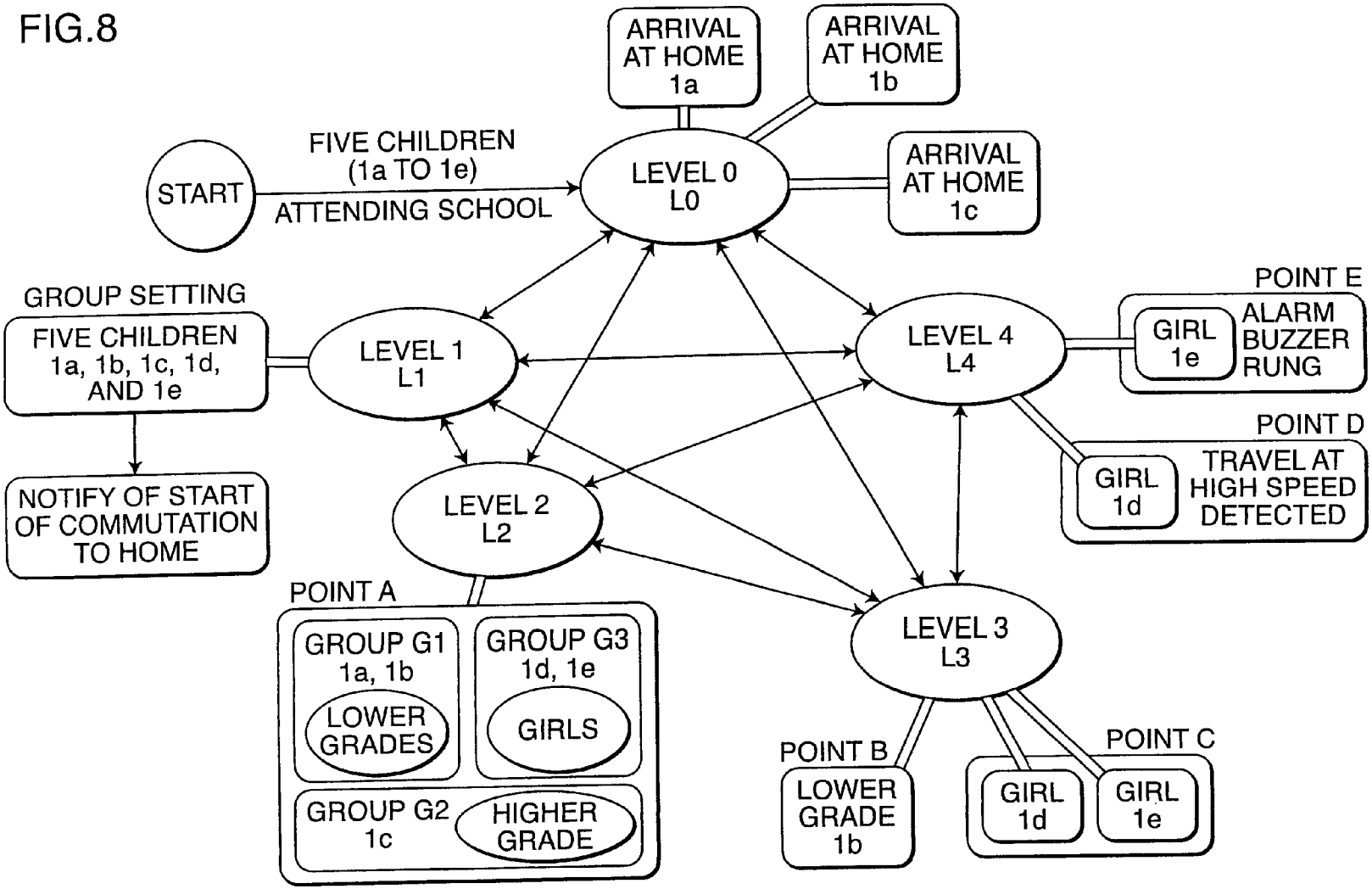
FIG. 8 is a state transition diagram of the monitor level of the present invention.

State Transition of Monitor Level and Communication Control of Monitor Information and the Like FIG. 8 shows an example of a monitor level state transition diagram.

The monitor level (L0 to L4) changes depending on the condition satisfied by the present situation of a monitor TE. The level changes not only to the neighboring level but may largely change due to a sharp turn in the condition.

For example, even when a plurality of children grouped start going to school as usual and act in the group in a relatively safe state, if a crime occurs in a neighboring area, the monitor level changes from L1 to L3. That is, a change in the monitor level can occur among all of the levels.

FIG. 8 also shows a concrete example of the state transition in a case where five children (1*a* to 1*e*) are grouped and go home from school. It is assumed that the five children stay in school in the beginning.

In this case, the state starts from the level 0 (L0) corresponding to the state where the condition 1 such that all of the five children have arrived at school is satisfied. The attribute information on the five children set in a group is assumed as follows. The child 1*a* is a girl child in the lower grade, the child 1*b* is a boy child in the lower grade, the child 1*c* is a boy child in the higher grade, and the children 1*d* and 1*e* are girl children in the higher grades.

At the time of commutation to their homes, the five children gather and operate for making a group setting by their own monitor TEs. When all of the children are registered in the white list and can be grouped, the group setting is executed. After that, when they start going home, the monitor level changes from the level 0 (L0) to the level 1 (L1), and a notification of start of commutation to homes is sent to the recognition TEs of guardians of the children.

It is assumed that five children are commuting to their homes together within a predetermined range in the beginning but are divided into three groups at a point A.

The three groups are a group G1 of the two children (1*a* and 1*b*) in the lower grades, a group G2 of one child (1*c*) in the higher grade, and a group G3 of the two girl children (1*d* and 1*e*) in the higher grades.

Since all of the three groups (G1, G2, and G3) satisfy the conditions 1, 2, and 3 at the level 2 (L2), the monitor level of each of the groups changes from the level 1 (L1) to the level 2 (L2).

It is assumed that the two children (1*a* and 1*b*) in the lower grades arrive at the home of the child 1*a* at a point B, the child 1*a* goes home, and the child 1*b* goes home alone after that. Since the child 1*a* arrived at home, the level is changed to the level 0 (L0). On the other hand, the child 1*b* who is a child in the lower grade becomes alone, the condition matches the condition 1 of the level 3 (L3). That is, the monitor level of the child 1*b* changes from the level 2 (L2) to the level 3 (L3), and the child 1*b* enters the priority monitor mode.

The state indicating that the monitor level of the child 1*b* who entered the priority monitor mode (level 3) is changed to the level 3 and the position information on the point B in which the monitor level was changed is notified to the guardian (home) of the child 1*b* and concerned parties persons such as school, local member, and police.

It is assumed that the two girl children (1*d* and 1*e*) in the higher grades are split at a point C at some midpoint of the return road and each of them goes home alone. Each of the children (1*d* and 1*e*) matches the condition 2 of the level 3 (L3) that "the number of girl children becomes one", so that the level 2 (L2) changes to the level 3 (L3). A notifying process similar to that performed to the child 1*b* is executed for each of the two girl children (1*d* and 1*e*) at the level 3.

For each of the children 1*b*, 1*d*, and 1*e*, the interval of notifying the position information from the monitor TE to the center is shortened and is set to "b" seconds. Further, when a guardian recognizes the change to the level 3 (L3) by the recognition TE, the guardian can call a warning by sound notification to the child.

It is assumed that it is detected that the girl child 1*d* who became alone travels at high speed different from the normal speed of going home at a point D. In this case, the girl child 1*d* matches the condition 1 of level 4 (detection of travel at impossible speed), so that the monitor level of the child 1*d* changes from the level 3 (L3) to the level 4 (L4). Therefore, the operation at the level 4 (L4) is executed. Concretely, the state of the level change and the position information at the point D is notifies to the guardian and the like and, in addition, a call for warning is notified to children around the point D and an instruction to rush to the site is notified to members in the neighboring areas.

It is assumed that the girl child 1*e* who became alone depresses the alarm buzzer at the point E. Since the condition matches the condition 2 of the level 4 (the child rings the alarm buzzer), the monitor level of the child 1*e* changes from the level 3 (L3) to the level 4 (L4). Therefore, the predetermined process as the operation of the level 4 is executed also for the child 1*e*.

When it is assumed that the boy child 1*c* in the higher grade who became alone at the point A arrives at home, the monitor level changes from the level 2 (L2) to the level 0 (L0). Similarly, when the child 1*b* in the lower grade who became alone at the point B arrives at home, the monitor level changes from the level 3 (L3) to the level 0 (L0).

The above-described state transition is an example. Each time an event matching the condition of any of the levels occurs, the monitor level changes and an operation adapted to the monitor level after the change is executed.

An example of the communication control on the monitor information and the like will be described below with reference to a concrete time chart of the state transition of the monitor levels.

First Example of Communication Control of the Invention

An example of the communication control on monitor information and the like in a state of monitoring two children who go home from school will be described.

Figure 9:
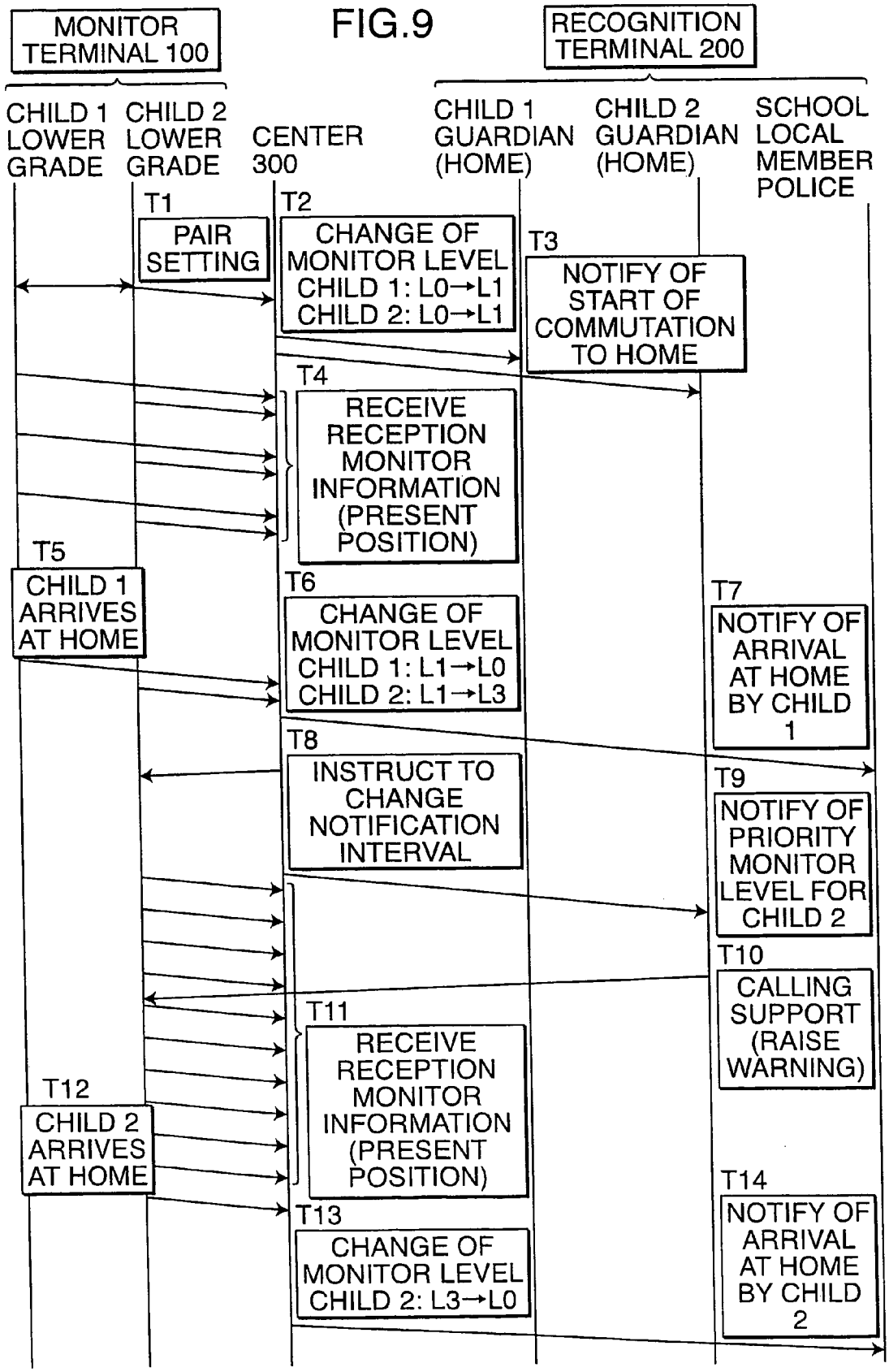
FIG. 9 is a time chart of a state change of the monitor level of a first embodiment of the present invention.

FIG. 9 shows an example of a time chart from school to home. It is assumed that each of the two children (1 and 2) in the lower grades has the monitor TE 100, and each of the guardian, school, local member, and police has the recognition TE 200.

First, at school, the child 1 and the child 2 in the lower grades are paired (event T1) by using their monitor TEs 100. The monitor level at this time is the level 0 (L0).

When it is assumed that the children 1 and 2 are registered in the white list, the pair setting unit 105 makes a pair setting and generates pair information. The generated pair information is transmitted by the transmitting unit 101 from the monitor TEs 100 to the center 300.

The present position information on the two children received by the GPS position information receiving unit 104 is also transmitted to the center.

In the center 300, when the pair information is received and start of commutation to home is detected from a change in the received present position information, the monitor level determining unit 305 changes the monitor level of each of the children 1 and 2 from the level 0 (L0) to the level 1 (L1) (event T2).

Since the condition 2 of the monitor level 1 (L1) is satisfied in the center 300, the operation adapted to the condition 2 of the level 1 is executed. In this case, a notification of start of commutation to home is transmitted to each of the guardians (homes) of the children 1 and 2 (event T3) as shown in FIG. 7A.

It is assumed that the two children walk together in the normal school roads without being apart from each other after that. The present position information on the two children is transmitted to the center at predetermined time intervals also during the walk (event T4).

Since the position information is transmitted when the monitor level is the relatively low level 1 (L1), the transmission interval may be set to be longer than the notification interval at the level 2. In the state of the level 4, the mutual distance recognizing unit 304 of the center always calculates the distance between the two children based on the present position information on the two children.

Further, it is assumed that after the state of the event T4 continues for a while, the two children arrive at home of the child 1 (event T5). When the monitor TE of the child 1 recognizes the arrival at home from the received GPS position information, the monitor TE of the child 1 transmits information indicative of arrival at home to the center. In this case, the condition 2 of the level 0 (L0) for the child 1 is satisfied. That is, when the center receives the information indicative of arrival at home of the child 1, the condition of the level 0 (L0) is satisfied. The monitor level determining unit 305 changes the monitor level of the child 1 from the level 1 (L1) to the level 0 (L0) (event T6).

In a case where the position information on the home of the child 1 is managed on the center side, the present position information sent from the monitor TE of the child 1 is compared with the position information on the house. When the information matches each other, it is determined that the child 1 arrived at home, and the monitor level determining unit 305 may determine that the condition 2 of the level 0 (L0) is satisfied.

Since the condition 2 of the monitor level 0 (L0) is satisfied for the child 1, a notification of arrival at home (notification of arrival at home of the child 1) is sent from the center to the school and the like (event T7).

The notification of arrival of the child 1 may be sent not necessarily at this timing but at the timing of an event 14 which will be described later. Specifically, after recognition that the two children who are paired have arrived at their homes, a notification of arrival at homes of the two children may be transmitted.

On the other hand, when the child 2 is parted from the child 1 around the home of the child 1, the center detects that the child 2 became alone by continuously receiving the present position information on the child 2.

To be concrete, the mutual distance recognizing unit 304 of the center recognizes the monitor reception information on the two children who are paired, obtains the present position information on both of the two children, and calculates the distance between the two children. The monitor level determining unit 305 compares the calculated mutual distance with predetermined distance (for example, 10 m). When the mutual distance exceeds the predetermined distance, it is determined that "the child 2 in the lower grade became alone".

Since the situation that the child 2 in the lower grade became alone matches the condition 1 of the level 3 (L3), the monitor level of the child 2 is changed from the level 1 (L1) to the level 3 (L3) (event T6).

The center executes the operation of the level 3 (L3) shown in FIG. 7B.

In FIG. 7B, the occurrence of the event matching the condition 1 of the level 3 (L3) and entrance of the priority monitor mode of the child 2 (the state information), and the present position information on the child 2 is notified from the center to the guardian of the child 2 (event. T9). Concretely, for example, the state where the child 2 is parted from the child 1 and becomes alone around the home of the child 1 on his/her way home is notified to the recognition TE of the guardian of the child 2.

Further, the center transmits an instruction to shorten the notification interval of the position information to "b" seconds to the recognition TE of the child 2 (event T8). The monitor TE of the child 2, which has received the notification interval changing instruction, changes the notification interval of the position information to "b" seconds. The order of the events T7, T8, and T9 is arbitrary.

After that, the present position information or the like is transmitted from the monitor TE of the child 2 to the center in the changed notification intervals (event T11). That is, the present position of the child 2 who becomes alone is recognized at shorter time intervals.

The guardian who recognized that the child 2 became alone at the event T9 calls a warning to the child 2 by "calling support" as necessary (event T1). For example, a notification in synthetic voice or an e-mail for calling warning is transmitted. Alternatively, the guardian may directly call the child 2 to raise a warning.

After that, the child 2 arrives at home (event T12). Whether the child 2 has arrived at home or not can be determined in a manner similar to a case of the event T5. Specifically, a notification of arrival at home is sent from the monitor TE of the child 2 to the center or the center recognizes a match between the present position of the child 2 and the latitude and longitude information on the house, thereby determining arrival at home.

When the center determines that the child 2 has arrived at home, the condition of the level 0 (L0) is satisfied, so that the monitor level is changed from the level 3 (L3) to the level 0 (L0) (event T13).

After that, arrival at home of the child 2 (notification of arrival) is transmitted from the center to the school, local members, and the like (event T14).

The time chart of an example of a case where two children are paired and go home from school has been described above. Also in a case where three or more children are grouped and go home from school, through the number of people increases, almost the same processes are performed.

As described above, some monitor levels are provided, and monitoring and operations are performed according to the situation of each of the levels. Thus, monitoring can be performed more properly, the load on the monitoring person is lessened, the safety of a person to be monitored is recognized more properly, a crime can be prevented, and an effect of suppressing crimes can be increased.

Second Example of Communication Control

An example of a case where the child 2 in the first example becomes alone and depresses the buzzer by himself/herself will be described.

FIG. 10 shows an example of a time chart after the child becomes alone. In the example, the monitor level of the child 2 changes from the level 3 (L3) to the level 4 (L4) and, finally, after arrival at home, becomes the level 0 (L0).

It is assumed that the present position information is periodically sent to the center from the monitor TE of the child 2 in the state of the event 11 in FIG. 9. Since something abnormal occurs in the child 2 in this state, the child 2 depresses the buzzer by his/her intention (event T21).

When the monitor TE of the child 2 recognizes the depression of the buzzer, the notification information generating unit 108 generates specific information (buzzer depression information) interlocked with the buzzer, and the transmitting unit 101 sends the information to the center. At this time, the position information on the point where the buzzer was depressed is also transmitted to the center.

The center 300 which has received the buzzer depression information recognizes that the condition 2 of the level 4 (L4) that "child rings the buzzer" is satisfied, so that the monitor level determining unit 305 changes the monitor level from the level 3 (L3) to the level 4 (L4) (event T22). After that, the operation of the level 4 is executed.

First, the condition 2 of the level 4 is satisfied, information on the state where the monitor level of the child 2 becomes the level 4 (L4) (state information) and the position information on the point where the buzzer is depressed is transmitted from the center to the recognition TEs of the home, police, school, and the local members (event T23).

The guardian and the school staff who recognized that the child 2 depressed the buzzer by the event T23 make a check on the child by sound or the like (calling support: event T25).

An instruction of changing the notification interval of the present position information is transmitted from the center to the monitor TE of the child 2 (event T24). In this case, an instruction to set the notification interval to the shortest time interval ("c" seconds) is given.

The monitor level of each of the other children near the point where the child 2 depressed the buzzer is changed to the level 3 (L3) (event T27).

Further, to the local members and guardians of other children near the point where the child 2 depresses the buzzer, the information that the child 2 depressed the buzzer at the point close to them, the position information on the point, and an instruction (request) to rush to the site where the buzzer is depressed are transmitted (event T26).

The local members and the like who recognized the rush instruction rush to the site where the child 2 depressed the buzzer and check the situation of the child 2 (event T28).

It is assumed that a local member near the site rushes to the site and recognizes the safety of the child 2 and, after that, the child 2 goes home as usual.

In this case, although not shown, when the safety of the child 2 is recognized by the center by cancellation of the buzzer of the monitor TE of the child 2, a notification to the center from the local member, or the like, the monitor level may be reset to the level 3 (L3). It is also possible to maintain the monitor level at the level 4 (L4) until the child 2 arrives at home.

After that, the child 2 arrives at home (event T29). In this case, like the event T12, the condition 2 of the level 0 (L0) is satisfied. Consequently, in the center, the monitor level of the child 2 is changed from the level 4 (L4) to the level 0 (L0) (event T30). "Notification of arrival at home" as the operation at the level 0 (L0) is transmitted to the concerned parties (event T31).

In this case, "notification of arrival at home of the child 2" may be sent not only the school, local members, and police, but also local members in the neighborhood of the site, to which the notification was sent in the event T26, and the children who were near the site and for whom the monitor level was changed at the event T27.

The monitor level of the children, which has been changed, may be reset to the original level on reception of "notification of arrival at home".

An example of the communication control in a case where an emergency at the level 4 (L4) occurs has been described above. However, even in a case where the state changes to the level 4, a communication control and operations of the concerned parties different from those shown in FIG. 10 may be executed.

Since the monitor level is determined by using the present position information on a person to be monitored as basic information and also information that can specify the person such as the grade, the communication control process can be performed more properly in accordance with the present situation of the person to be monitored.

By the communication control as in the example, the load on the monitoring person can be lessened, more proper process can be performed, and the invention can contribute to prevent or suppress crimes.

Other Embodiments

Although the state information and present position information is notified to the guardian, and the like having the recognition TE by the "operations" shown in FIGS. 7A and 7B, since the attribute information (name, grade, sex, and the like) specifying the child is also stored as child information in the storing unit 303 in the center, the attribute information on the child may be included in the state information.

By including the attribute information, accurate recognition can be performed more easily on the recognition TE side.

It is assumed that a notification of state information that the group G1 is made of only children in the lower grades of the condition 1 having the level 2 (L2) is transmitted to the recognition TE of a guardian. In a case where the notification includes the attributes of the grade and sex of each of the children, the notification information generating unit 203 generates notification information so that the attributes are visually distinguished from each other.

By distinguishing the children in the group G1 from each other in different shapes and different colors of icons according to the grades and sex and displaying the icons of the children in the present position of the group G1 together with the map of the school roads, the composition of the children in the present group is clear. For example, a first grader is displayed as ○, a second grader is displayed as □, a third grader is displayed as Δ, a boy is displayed in blue, and a girl is displayed in red.

In a case where the names of children are included in the state notification, by displaying the names around the icons of the children displayed, the guardians can recognize their children more accurately, and a feeling of security increases.

Since the position information on each child is transmitted from the monitor TE to the center at predetermined time intervals, by notifying of the state from the center to the recognition TE at similar time intervals, the guardian can visually grasp the state of commutation to/from school on the display of the recognition TE in an almost real-time manner.

In a case where the risk is high such as the level 3 or 4, by combining flash display of the icon of a child or notification with sound, the guardian can recognize the state more accurately.

When a child in the lower grade becomes alone at the level 3, by visually displaying a map indicating the present position of the child and performing notification with sound (for example, "the child "b" is coming home alone at the point B") in the recognition TE, the guardian can expect time of arrival at home accurately, so that a feeling of security increases.

After a child becomes alone, the present position is flashed on a map. The guardian can visually recognize that, for example, the child is entering a blind road. In such a case, just before the road, the guardian can make a call from the recognition TE side to the child and may tell the child to be careful. Alternatively, the guardian can instruct the child to take another bypass or wait in a safe place until the guardian picks the child up.

In a case of setting, not a child, a wandering person, a tour participant, a team worker, or the like as the person to be monitored, conditions of the monitor levels and operations according to the situation of the person are set. Therefore, monitor levels and operations different from those of the embodiments can be also set.

According to the present invention, a monitor level of a person to be monitored is determined by using a distance between monitoring terminals and attribute information on the person to be monitored, so that more accurate monitoring and more prompt response can be performed in accordance with the present state of the person to be monitored.

In particular, by using not only present position but also the mutual distance of two or more persons to be monitored and the attribute information, a dangerous state which cannot be grasped only from the position can be detected.

For example, in a case where the person to be monitored walks alone apart from a group although the person walks on a normal school road, it can be detected that the person is in the dangerous state.

By an operation and a notification of state information associated with the monitor level, monitoring load on a monitoring person can be lessened, safety can be recognized more accurately, crimes can be prevented, and an effect of suppressing crimes can be improved.

What is claimed is:

1. A communication control system comprising a monitoring terminal held by each of a plurality of persons to be monitored and an information managing apparatus for managing position information on the monitor terminal, wherein the monitor terminal includes a position information obtaining unit for obtaining geographical position information, a group setting unit for setting a group of monitor terminals of persons to be monitored who are allowed to be mutually grouped, and a first transmitting unit for transmitting the obtained position information and group setting information to the information managing apparatus, and the information managing apparatus includes a first receiving unit for receiving the position information and the group setting information, a management information storing unit for storing attribute information on the person to be monitored and a condition for determining a monitor level of the person to be monitored, a mutual distance recognizing unit for calculating a distance between the monitor terminals from the position information received from each of the monitor terminals belonging to the set group, and a monitor level determining unit for determining the present monitor level of the person to be monitored based on the calculated distance, the attribute information on the person to be monitored, and the monitor level determination condition.

2. The communication control system according to claim 1, further comprising a recognition terminal for recognizing a monitor state of the specific person to be monitored, wherein the information managing apparatus executes an operation preliminarily associated to the monitor level determined by the monitor level determining unit, and notifies the recognition terminal of state information for identifying the present monitor level of the person to be monitored.

3. The communication control system according to claim 2, wherein the recognition terminal includes an input unit for registering the attribute information on the respective person to be monitored and a list of the persons to be monitored who are allowed to be mutually grouped, and a second transmitting unit for transmitting the attribute information on the registered persons to be monitored to the information managing apparatus and transmitting the list of the persons to be monitored to the monitor terminal.

4. The communication control system according to claim 3, wherein the monitor terminal includes a monitor information storing unit for storing the list of the persons to be monitored, and the group setting unit sets a group of only monitor terminals of the persons to be monitored included in the list of the persons to be monitored and does not set a group with a monitor terminal of a person to be monitored who is not included in the list.

5. The communication control system according to claim 2, wherein the recognition terminal includes a notification information generating unit for generating notification information to be notified to a monitoring person by using the state information on the person to be monitored, which is notified from the information managing apparatus.

6. The communication control system according to claim 5, wherein the recognition terminal includes a notifying unit, the state information on the person to be monitored notified from the information managing apparatus includes the present monitor level of the person to be monitored, the present position information, and the attribute information, the notification information generated by the notification information generating unit includes map information visually displaying the notified state information and sound information auditorily notifying the notified state information, and the notifying unit displays the map information and outputs the sound information.

7. The communication control system according to claim 1, wherein the management information storing unit in the information managing apparatus pre-stores monitor level information including a condition for determining the monitor level and an operation executed when the condition is satisfied, and the monitor level information includes at least a non-monitor state level for not monitoring the person to be monitored, a first monitor level for indicating that the group is set and monitoring starts, and a second monitor level indicating that, after the start of monitoring, a specific person to be monitored included in the set group becomes alone or with not more than a predetermined number of persons.

8. The communication control system according to claim 7, wherein the specific person to be monitored at the second monitor level is determined based on the attribute information on the person to be monitored.

9. The communication control system according to claim 1, wherein the attribute information on the person to be monitored includes at least one of the name, sex, age, grade, school name, guardian specifying information, and contact information on the person to be monitored.

10. The communication control system as in any one of claims 1 to 9, wherein the person to be monitored is a child, a wandering person, a tour participant, or a team worker.

* * * * *